US012656027B2

(12) United States Patent
Cheng et al.

(10) Patent No.: US 12,656,027 B2
(45) Date of Patent: Jun. 16, 2026

(54) MULTI-LAYERED ELECTROCALORIC HEAT PUMP SYSTEMS AND METHODS

(71) Applicant: Auburn University, Auburn, AL (US)

(72) Inventors: Zhongyang Cheng, Aurburn, AL (US); Farrukh Najmi, Aurburn, AL (US); Wei Yi, Auburn, AL (US)

(73) Assignee: Auburn University, Auburn, AL (US)

( * ) Notice: Subject to any disclaimer, the term of this patent is extended or adjusted under 35 U.S.C. 154(b) by 349 days.

(21) Appl. No.: 18/351,891

(22) Filed: Jul. 13, 2023

(65) Prior Publication Data

US 2024/0019179 A1 Jan. 18, 2024

Related U.S. Application Data

(60) Provisional application No. 63/410,469, filed on Sep. 27, 2022, provisional application No. 63/388,865, filed on Jul. 13, 2022.

(51) Int. Cl.
*F25B 21/00* (2006.01)

(52) U.S. Cl.
CPC ..... *F25B 21/00* (2013.01); *F25B 2321/001* (2013.01)

(58) Field of Classification Search
CPC ..... F25B 21/00; F25B 2321/001; Y02B 30/00
See application file for complete search history.

(56) References Cited

U.S. PATENT DOCUMENTS

| | | | | |
|---|---|---|---|---|
| 4,757,688 | A * | 7/1988 | Basiulis | F25B 21/00 62/3.2 |
| 6,725,668 | B1 * | 4/2004 | Cornwall | H10N 15/20 322/29 |
| 8,371,128 | B2 * | 2/2013 | Kruglick | H01L 23/427 62/3.1 |
| 8,769,967 | B2 * | 7/2014 | Kruglick | F25B 21/00 62/3.3 |
| 9,500,392 | B2 * | 11/2016 | Kruglick | F25B 21/04 |
| 9,671,140 | B2 * | 6/2017 | Kruglick | F25B 21/00 |
| 9,915,446 | B2 * | 3/2018 | Malic | F25B 21/00 |
| 10,837,681 | B2 * | 11/2020 | Mantese | F25B 21/00 |
| 11,137,172 | B2 * | 10/2021 | Kniffler | F25B 25/005 |
| 11,346,586 | B2 * | 5/2022 | Xie | F28F 13/16 |
| 11,428,444 | B2 * | 8/2022 | Eastman | F25B 21/00 |
| 2011/0016885 | A1 * | 1/2011 | Zhang | F25B 21/00 62/3.1 |

(Continued)

*Primary Examiner* — Filip Zec
(74) *Attorney, Agent, or Firm* — Barnes & Thornburg LLP

(57) ABSTRACT

In at least one illustrative embodiment, a cooling system includes a heat source, multiple electrocaloric material layers coupled to the heat source, and a heat sink coupled to the electrocaloric material layers. An electric field applied to each electrocaloric material layer is independently controllable. The electric field applied to each electrocaloric material layer is operable to move heat energy from the heat source to the heat sink during an interval, and to restore initial conditions of the electrocaloric material layers during a subsequent interval. The heat sink, the electrocaloric material layers, and the heat source may be bonded together. The electrocaloric material layers and the heat source may be bonded together, and the heat sink may be removably coupled to the electrocaloric material layers. Other embodiments are described and claimed.

20 Claims, 7 Drawing Sheets

(56) References Cited

U.S. PATENT DOCUMENTS

| | | | | |
|---|---|---|---|---|
| 2013/0067935 | A1* | 3/2013 | Kruglick | F25B 21/00 62/3.2 |
| 2015/0075182 | A1* | 3/2015 | Cheng | F25B 21/00 62/3.1 |
| 2015/0082809 | A1* | 3/2015 | Schwartz | F25B 21/00 62/3.1 |
| 2016/0087185 | A1* | 3/2016 | Cheng | F25B 21/00 62/3.1 |
| 2018/0363956 | A1* | 12/2018 | Eastman | B60H 1/32 |
| 2020/0096240 | A1* | 3/2020 | Hou | F25B 23/00 |
| 2021/0151655 | A1* | 5/2021 | Eastman | C08F 18/24 |
| 2021/0180838 | A1* | 6/2021 | Eastman | F25B 49/00 |

* cited by examiner

MULTI-LAYERED ELECTROCALORIC HEAT PUMP SYSTEMS AND METHODS

CROSS-REFERENCE TO RELATED APPLICATIONS

The present application claims priority under 35 U.S.C. § 119(e) to U.S. Provisional Application Ser. No. 63/388,865, filed Jul. 13, 2022, and to U.S. Provisional Application Ser. No. 63/410,469, filed Sep. 27, 2022, the entire disclosure of each of which is hereby incorporated by reference.

BACKGROUND

The electrocaloric effect means a material releases heat when subject to an electric field and absorbs heat when the electric field is turned off. Electrocaloric materials (ECMs) are materials exhibiting useful electrocaloric effect. Cooling systems using ECMs with a high/giant electrocaloric effect have been designed. Typical cooling systems move ECMs (as solid or liquid) from one location in which heat is absorbed to another location in which heat is released.

SUMMARY

In one aspect of the disclosure, a cooling system comprises a heat source, a plurality of electrocaloric material layers coupled to the heat source, and a heat sink coupled to the plurality of electrocaloric material layers. An electric field applied to each electrocaloric material layer is independently controllable. The electric field applied to each electrocaloric material layer is operated to move a first amount of heat energy from the heat source to the heat sink during a first interval and to restore an initial condition of the plurality of electrocaloric material layers during a second interval after the first interval.

In an embodiment, the plurality of electrocaloric material layers are separated by layers of electrically conductive materials. In an embodiment, the plurality of electrocaloric material layers are separated by layers of electrically insulative materials. In an embodiment, the plurality of electrocaloric material layers comprises lead magnesium niobate (PMN) or barium titanate (BT) and the heat sink comprises copper, silver, or aluminum. In an embodiment, the heat source comprises a silicon die.

In an embodiment, the cooling system further comprises a controller coupled to the plurality of electrocaloric material layers and configured to independently control the electric field applied to each electrocaloric material layer.

In an embodiment, the plurality of electrocaloric material layers comprises a first layer bonded to the heat sink and a second layer bonded between the first layer and the heat source. In an embodiment, during the first interval, a first electric field applied to the first layer is increased from a first field strength to a second field strength thereby causing a temperature of the first layer to increase from an equilibrium temperature by a predetermined temperature delta, and a second electric field applied to the second layer is decreased from the second field strength to the first field strength thereby causing a temperature of the second layer to decrease from the equilibrium temperature by the predetermined temperature delta. During a first subinterval of the second interval, the first electric field is decreased from the second field strength to the first field strength thereby causing the temperature of the first layer to decrease from the equilibrium temperature by the predetermined temperature delta, and the second electric field is maintained. During a second subinterval of the second interval, the first electric field is maintained and the second electric field is increased from the first field strength to the second field strength thereby causing the temperature of the second layer to increase from the equilibrium temperature by the predetermined temperature delta. In an embodiment, during a third subinterval of the second interval prior to the first subinterval, the first electric field is increased and the second electric field is increased, and during a fourth subinterval of the second interval after the second subinterval, the first electric field is decreased and the second electric field is decreased.

In an embodiment, the first interval lasts a predetermined time until the first amount of heat energy is transferred to the heat sink. Each of the first subinterval and the second subinterval lasts until the heat sink, the plurality of electrocaloric material layers, and the heat source reach the equilibrium temperature. In an embodiment, the first interval lasts until a temperature maximum reaches an interface between the first layer and the heat sink.

In an embodiment, a net heat transfer during the second interval between the heat source and the heat sink is zero.

In an embodiment, the initial condition comprises a respective initial electric field strength for each layer of the plurality of electrocaloric material layers. The initial condition further comprises an equilibrium temperature for the plurality of electrocaloric material layers.

In an embodiment, the plurality of electrocaloric material layers comprises a first layer bonded to a second layer, wherein the first layer is detachably coupled to a first component of the heat sink and the heat source, and wherein the second layer is bonded to a second component of the heat sink and the heat source other than the first component. In an embodiment, during the first interval, the first component of the heat sink and the heat source is attached to the first layer, a first electric field applied to the first layer is increased from a first field strength to a second field strength thereby causing a temperature of the first layer to increase from an equilibrium temperature by a predetermined temperature delta, and a second electric field applied to the second layer is decreased from the second field strength to the first field strength thereby causing a temperature of the second layer to decrease from the equilibrium temperature by the predetermined temperature delta. During the second interval, the first component of the heat sink and the heat source is detached from the first layer, the first electric field is decreased from the second field strength to the first field strength thereby causing the temperature of the first layer to decrease from the equilibrium temperature by the predetermined temperature delta and the second electric field is increased from the first field strength to the second field strength thereby causing a temperature of the second layer to increase from the equilibrium temperature by the predetermined temperature delta.

In an embodiment, the first interval lasts a predetermined time until the first amount of heat energy is transferred to the heat sink. The second interval lasts until the plurality of electrocaloric material layers and the heat source reach the equilibrium temperature. In an embodiment, the first interval lasts until a temperature maximum reaches an interface between the first layer and the heat sink.

In an embodiment, the cooling system further comprises an electrically conductive cantilever coupled to the heat sink. The cantilever is moveable between a first position in which the cantilever contacts the first layer and a second position in which the cantilever is spaced apart from the first layer.

In an embodiment, the cooling system further comprises an electrically conductive cantilever coupled to the heat sink, wherein the cantilever is bonded to the second layer. The cantilever is moveable between a first position in which the first layer contacts the heat source and a second position in which the first layer is spaced apart from the heat source.

In an embodiment, the cooling system further comprises an electrically conductive cantilever coupled to the heat sink, and the plurality of electrocaloric material layers further comprise a third layer bonded to the cantilever and a fourth layer bonded to the third layer. The cantilever is moveable between a first position in which the fourth layer contacts the first layer and a second position in which the fourth layer is spaced apart from the first layer.

BRIEF DESCRIPTION OF THE DRAWINGS

The concepts described in the present disclosure are illustrated by way of example and not by way of limitation in the accompanying figures. For simplicity and clarity of illustration, elements illustrated in the figures are not necessarily drawn to scale. For example, the dimensions of some elements may be exaggerated relative to other elements for clarity. Further, where considered appropriate, reference labels have been repeated among the figures to indicate corresponding or analogous elements. The detailed description particularly refers to the accompanying figures in which.

DETAILED DESCRIPTION OF THE DRAWINGS

Figure 1:
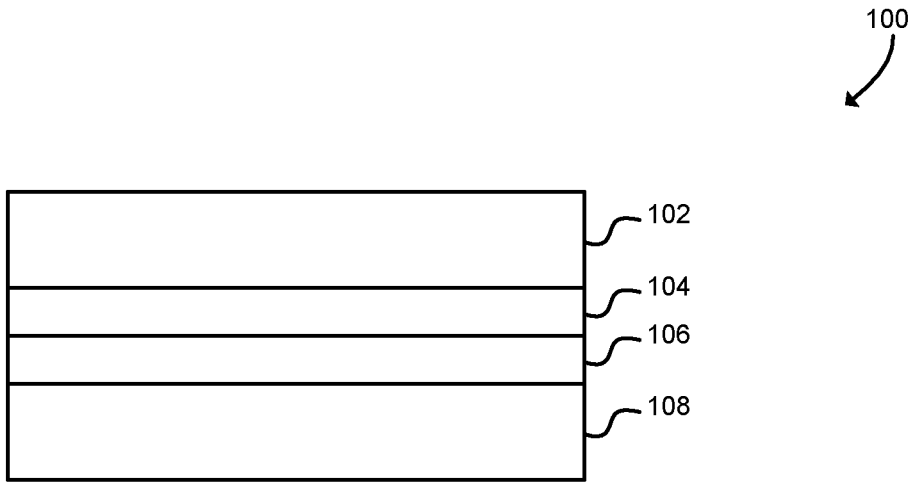
FIG. 1 is a schematic diagram of at least one embodiment of a multi-layer electrocaloric heat pump device.

While the concepts of the present disclosure are susceptible to various modifications and alternative forms, specific embodiments thereof have been shown by way of example in the drawings and will be described herein in detail. It should be understood, however, that there is no intent to limit the concepts of the present disclosure to the particular forms disclosed, but on the contrary, the intention is to cover all modifications, equivalents, and alternatives consistent with the present disclosure and the appended claims.

References in the specification to "one embodiment," "an embodiment," "an illustrative embodiment," etc., indicate that the embodiment described may include a particular feature, structure, or characteristic, but every embodiment may or may not necessarily include that particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to effect such feature, structure, or characteristic in connection with other embodiments whether or not explicitly described. Additionally, it should be appreciated that items included in a list in the form of "at least one A, B, and C" can mean (A); (B); (C); (A and B); (A and C); (B and C); or (A, B, and C). Similarly, items listed in the form of "at least one of A, B, or C" can mean (A); (B); (C); (A and B); (A and C); (B and C); or (A, B, and C).

In the drawings, some structural or method features may be shown in specific arrangements and/or orderings. However, it should be appreciated that such specific arrangements and/or orderings may not be required. Rather, in some embodiments, such features may be arranged in a different manner and/or order than shown in the illustrative figures. Additionally, the inclusion of a structural or method feature in a particular figure is not meant to imply that such feature is required in all embodiments and, in some embodiments, may not be included or may be combined with other features. It should be appreciated that, as used herein, terms such as "top," "bottom," "horizontal," "vertical," etc. may be used to describe relative positions of components but do not imply that a particular orientation of a device is required.

Referring now to FIG. 1, an illustrative electrocaloric heat pump device 100 includes a heat sink 102, electrocaloric material (ECM) layers 104, 106, and a heat source 108. In an embodiment, the heat sink 102 may be embodied as a thermal reservoir and may be formed from copper, aluminum, silver, or any other thermally conductive material. Additionally or alternatively, in some embodiments, the heat sink 102 may be embodied as air or another thermally insulative material. In the illustrative embodiment, the heat sink 102 is bonded or otherwise permanently attached to the top ECM layer 104.

Each ECM layer 104, 106 may be embodied as any electrocaloric material—that is, any material exhibiting a useful electrocaloric effect. The ECM layers 104, 106 may be embodied as bulk ceramics or other bulk materials, thin films (e.g., with a thickness less than 1 μm), thick ceramic films (e.g., with thickness between 10 μm and 100 μm), or other configurations. In some embodiments, each ECM layer 104, 106 may include a stack of multiple sublayers of ECM that are each operated upon by the same electric field. In some embodiments, the ECM layers 104, 106 may be embodied as a ferroeletric material including inorganic ferroelectric materials such as barium titanate (BT), lead zirconate titanate (PZT), barium strontium titanate (BST), ammonium-based and glycine-based sulfates and selenates; organic ferroelectric materials such as polyvinylidene-fluoride (PVDF) copolymers and terpolymers; and other normal ferroelectrics. In some embodiments, the ECM layers 104, 106 may be embodied as an antiferroelectric material such as Ba-doped lead zirconate (PBZ), which may exhibit a negative electrocaloric effect (i.e., temperature decreasing with increased electric field). In some embodiments, the ECM layers 104, 106 may be embodied as relaxor ferroelectric materials such as lead magnesium niobate (PMN), lead magnesium niobate-lead titanate (PMN-PT), PLZT, PSN, and PST. The ECM layers 104, 106 may each be embodied as the same material or different materials.

Although illustrated as including two ECM layers 104, 106, it should be understood that in some embodiments, the heat pump 100 may include more than two ECM layers.

The heat source 108 may be embodied as any heat generation source. In some embodiments, the heat source 108 may be a silicon die, chip, or other integrated circuit, which may generate heat during operation. In some embodiments, the heat source 108 may be a heat spreader, heat pipe, cap, thermally conductive pad, or other material that may conduct heat from a silicon chip or other heat source. The bottom ECM layer 106 is bonded or otherwise permanently attached to the heat source 108.

As described further below, an independently controllable, time-dependent electric field may be applied to each of the ECM layers 104, 106. Accordingly, the heat pump 100 may further include one or more wires, traces, or other electrically conductive materials configured to generate controllable electric fields within the ECM layers 104, 106. As the ECM layers 104, 106 are permanently attached to the heat sink 102 and/or the heat source 108, those wires or other electrically conductive materials may not be required to move or otherwise change position, and thus also may be permanently attached to the ECM layers 104, 106. Further, the heat pump 100 may include one or more controllers, microcontrollers, microprocessors, digital signal processors (DSPs), or other control circuits configured to control the electric fields generated within the ECM layers 104, 106. In use, the electric field applied to each of the ECM layers 104, 106 is operated to move an amount of thermal energy from the heat source 108 to the heat sink 102 during a first interval, and to restore initial thermal conditions of the heat pump 100 during a second interval. During the second interval, no net thermal energy is moved within the heat pump 100. The operations of the first interval and the second interval may be cyclically repeated, allowing the heat pump 100 to move an amount of thermal energy from the heat source 108 to the heat sink 102 during every cycle. As described below, the heat pump 100 may move thermal energy even when the temperatures of the heat sink 102 and the heat source 108 are the same or, in some embodiments, if the temperature of the heat sink 102 is greater than the heat source 108. Accordingly, the heat pump 100 may perform cooling without including any moving parts. Thus, the heat pump 100 disclosed herein may have improved reliability and/or reduced costs as compared to existing ECM cooling systems that rely on moving parts (including moving ECM components, associated wiring, and/or other components).

Figure 2:
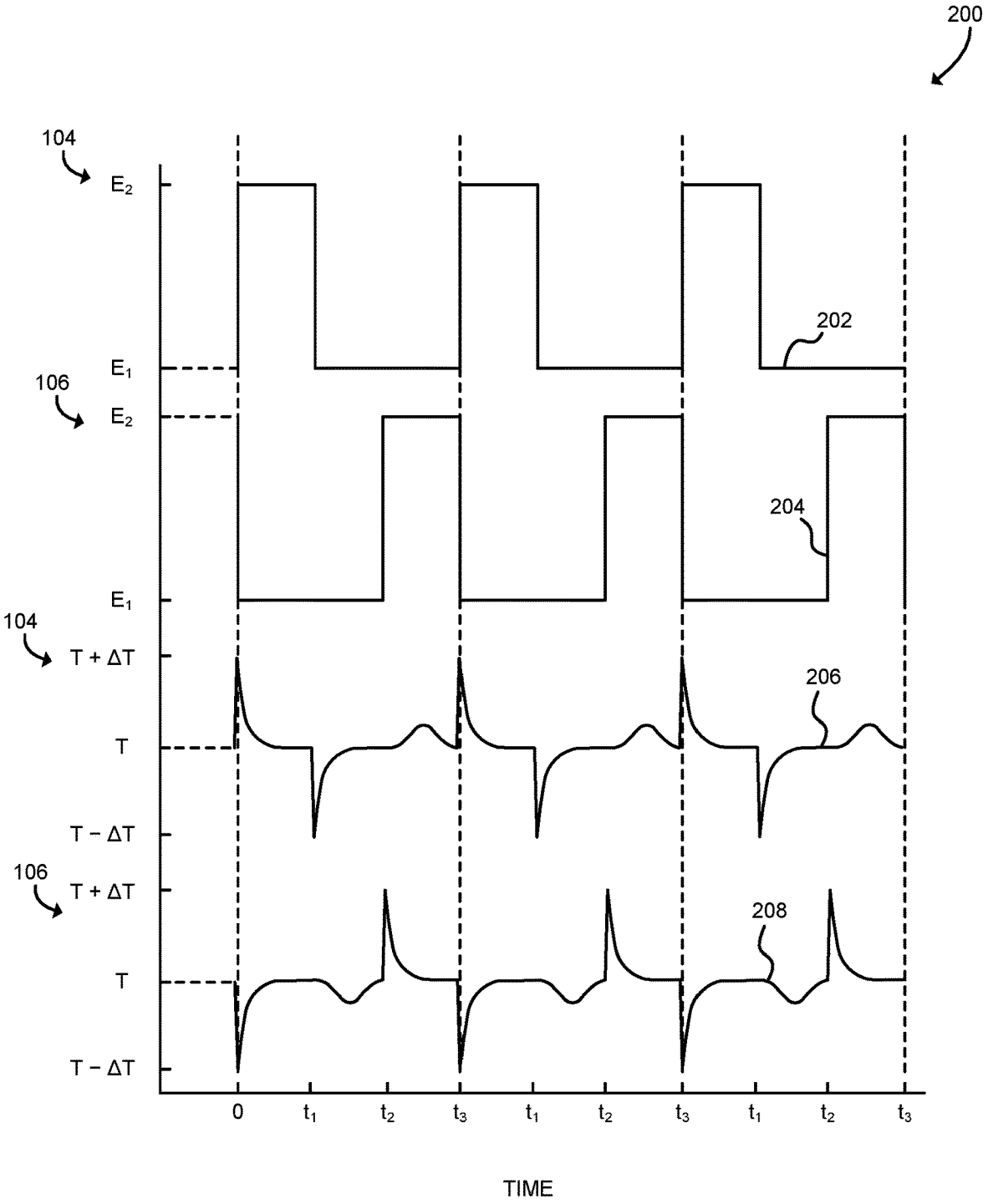
FIG. 2 is a chart illustrating at least one embodiment of coordinated electric fields and associated temperatures that may be used with the electrocaloric heat pump device of FIG. 1.

Referring now to FIG. 2, diagram 200 illustrates one potential embodiment of time-dependent electric fields that may be applied to the heat pump 100. Curve 202 illustrates electric field applied to the ECM layer 104, and curve 204 illustrates electric field applied to the ECM layer 106. Curve 206 illustrates temperature at the center of the ECM layer 104, and curve 208 illustrates temperature at the center of the ECM layer 106. Illustratively, at time zero, all components of the heat pump 100 (e.g., the heat sink 102, the ECM layers 104, 106, and the heat source 108) are at an equilibrium temperature T. As shown, at time zero, electric field strength in the ECM layer 104 is increased from $E_1$ to $E_2$. This change is applied adiabatically, which causes the temperature of the ECM layer 104 to increase by ΔT. Similarly, at time zero, electric field strength in the ECM layer 106 is decreased from $E_2$ to $E_1$, causing temperature of the ECM layer 106 to decrease by ΔT. The components of the heat pump 100 e.g., the heat sink 102, the ECM layers 104, 106, and the heat source 108) are allowed to reach the equilibrium temperature T (or within some tolerance of the equilibrium temperature T) through thermal conduction. Accordingly, the ECM layer 104 releases heat in an amount Q, and the ECM layer 106 absorbs heat in the amount Q. Assuming initial temperatures of the layers 104, 106 are the same and that all materials have the same thermal properties, this results in an amount of heat up to Q/2 flowing from the ECM layer 104 to the heat sink 102 and the amount of heat up to Q/2 flowing from the heat source 108 to the ECM layer 106.

At time $t_1$, the electric field strength in the ECM layer 104 is decreased from $E_2$ to $E_1$, and the electric field strength in the ECM layer 106 is maintained at $E_1$. This causes temperature of the ECM layer 104 to decrease by ΔT. As shown, temperature in the ECM layer 106 also subsequently decreased by an amount less than ΔT as the components of the heat pump 100 reach the equilibrium temperature T (or within the tolerance of the equilibrium temperature T). Accordingly, the ECM layer 104 absorbs heat in the amount Q, which results in an amount of heat up to Q/2 flowing from the heat sink 102 to the ECM layer 104, and the amount of heat up to Q/2 flowing from the heat source 108 to the ECM layer 106.

At time $t_2$, the electric field strength in the ECM layer 104 is maintained and the electric field strength in the ECM layer 106 is increased from $E_1$ to $E_2$. This causes temperature of the ECM layer 106 to increase by ΔT. As shown, temperature in the ECM layer 106 also subsequently increased by an amount less than ΔT as the components of the heat pump 100 reach the equilibrium temperature T (or within the tolerance of the equilibrium temperature T). Accordingly, the ECM layer 104 releases heat in the amount Q, which results in an amount of heat up to Q/2 flowing from the ECM layer 104 to the heat sink 102, and the amount of heat up to Q/2 flowing from the ECM layer 106 to the heat source 108. Thus, heat flows resulting from electric field changes at $t_1$ and $t_2$ cancel each other out. Accordingly, after reaching the equilibrium temperature immediately before time $t_3$, the total net heat flow is an amount up to Q/2 from the heat source 108 to the heat sink 102. Additionally, immediately before $t_3$, the electric field strengths in the ECM layers 104, 106 are returned to their initial conditions from immediately prior to time zero. As shown, the time-dependent electric fields applied to the ECM layers 104, 106 maybe repeated in multiple cycles, with each cycle moving up to Q/2 thermal energy from the heat source 108 to the heat sink 102.

The temperature profiles for the components of the heat pump 100, the amount of heat transferred in each cycle, the timing for electric field changes, and other attributes of the system 100 may be determined analytically. The heat pump 100 may be modeled as a four-body system. The two bodies at the ends (representing the heat sink 102 and the heat source 108) are modeled as semi-infinite bodies, and the two center bodies are modeled as finite ECM bodies. One-dimensional transient heat conduction of this four-body system may be solved analytically. The unsteady one-dimensional heat equation for those four bodies can be written as Equation 1, below. In Equation 1, $T_j(x, t)$ (j=1, 2, 3, 4) are the temperatures at time t and one-dimensional linear location x in the body j; $\alpha_j = k_j/\rho_j c_{\rho j}$ ($m^2/s$) are the thermal diffusivity of the body j, in which $k_j$ ($Wm^{-1}K^{-1}$), $\rho_j$ ($kg/m^3$), and $c_{\rho j}$ (J/Kkg) are the thermal conductivity, mass density, and heat capacity, respectively, of the body j. In an illustrative embodiment, the outer bodies (j=1, 4, corresponding to the heat sink 102 and the heat source 108) may have the same parameters, and similarly the center bodies (j=2, 3, corresponding to the ECM layers 104, 106) may have the same parameters. This problem may be solved analytically for temperature profile of each body (temperature of body as a function of time t and location x), which results in a summation of infinite series for each body. It has been determined that these series are convergent, meaning that the sum of the first N terms may be used as the sum of the series. It was determined that a numerical solution may be calculated using a relatively small number of terms (e.g., N=4, N<20, or N<70). The temperature profiles may also be used to analytically determine heat flux through interfaces between the bodies and heat energy transfer through the interfaces between the bodies.

$$\frac{\partial T_j(x,t)}{\partial t} = \alpha_j \frac{\partial^2 T_j(x,t)}{\partial x^2} \tag{1}$$

Directional heat transfer through an interface (e.g., through the interface between the heat source 108 and the ECM layer 106) depends strongly on the interfacial temperature $T_s$ and the temperature profiles across the interface. $T_s$ may be determined by the surface temperature of the two bodies at the surface and the relative thermal activity of bodies across the interface. Relative thermal activity may be characterized by the contacting coefficient $K_\varepsilon$, which may be calculated using Equation 2, below.

$$K_\varepsilon = \frac{k_j}{k_{j+1}\sqrt{\frac{\alpha_{j+1}}{\alpha_j}}} \ (>0) \tag{2}$$

For analysis, the cycle of applied electric field strengths shown in FIG. 2 may be divided into Step-I (for $0 \le t < t_1$), Step-II (for $t_1 \le t < t_2$), and Step-III (for $t_2 \le t < t_3$). As described above, it is determined that overall heat flow in Step-II and Step-III cancel each other out. For Step-I, shortly after time zero, there are two characteristic points: one at which the temperature is at the maximum (e.g., within the ECM layer 104), and the other at which the temperature is at the minimum (e.g., within the ECM layer 106). This creates a positive temperature gradient at the interface between center body and the corresponding outer body (e.g., between the ECM layer 106 and the heat source 108, or between the ECM layer 104 and the heat sink 102). Over time, as the bodies reach the equilibrium temperature, the location of each of these characteristic points moves away from x=0. Thus, there is initially heat flow from the heat source 108 to the ECM layer 106 (and also from the ECM layer 104 to the heat sink 102). As time goes on, the temperature gradient at the interface between the ECM layers 102, 104 decreases, meaning that heat flow decreases. At a certain time ($t_r$), the temperature gradient at the interface between the ECM layer 106 and the heat source 108 reaches zero. Put another way, at time $t_r$, the minimum temperature reaches the interface between the ECM layer 106 and the heat source 108 (and the maximum temperature reaches the interface between the ECM layer 104 and the heat sink 102). After time $t_r$, heat flows back from the ECM layer 106 into the heat source 108 (and back from the heat sink 102 into the ECM layer 104). In other words, after time $t_r$, heat removed from the heat source 108 is reduced. Therefore, if Step-II starts at time $t_r$ (i.e., $t_1=t_r$), then a non-zero net heat may be transferred from the heat source 108 to the heat sink 102. However, when the contacting coefficient $K_\varepsilon$ is large, the temperature in the ECM layers 104, 106 may be significantly different from the equilibrium temperature. When $K_\varepsilon$ is very small, the interface temperature $T_s$ at time $t_r$ is very close to the equilibrium temperature T. Accordingly, ut can be determined that using a smaller $K_\varepsilon$ transfers more heat energy and thus results in an improved cooling pump.

As an example, in an illustrative embodiment, the heat sink 102 and the heat source 108 are copper, and the ECM layers 104, 106 are PMN-4.5PT, which corresponds to $K_\varepsilon=0.0172<<1$. In that example, given an electric field strength resulting in $\Delta T=\pm 1°$ C., at time $t_r=4.5637$ s, the temperature at the surface of the ECM layer 106 is only 0.0061° C. different from the equilibrium temperature T, or 0.61% of the temperature change ΔT. Average temperature of the ECM layer 106 is about 0.003° C. or 0.3% of ΔT. Therefore, when Step-II starts at time $t_r$, the analytical results described above are still valid. Thus, after a three-step process cycle (i.e., from time zero to $t_3$), a non-zero amount of heat is transferred from the heat source 108 to the ECM layer 106, which is also the heat transferred from the ECM layer 104 to the heat sink 102. It has been calculated that in the illustrative embodiment, the amount of thermal energy transferred from the heat source 108 to the ECM layer 106 (and from the ECM layer 104 to the heat sink 102) is about 49% of ΔQ (which is the thermal energy induced in the ECM layer 106 by the electrocaloric effect). Thus, it has been determined that, to achieve a larger amount of heat transferred from the heat source 108 to the heat sink 102, the heat sink 102 and the heat source 108 should have a much higher thermal conductivity than the ECM layers 104, 106 (i.e., $K_\varepsilon$ should be small). Additionally, material for the heat source 108 and the heat sink 102 with a higher volumetric heat capacity is also favorable. The heat transferred from the heat source 108 to the heat sink 102 as a proportion of the heat released in one ECM layer is independent of both thickness of the ECM and the ΔT (which is related to the electric field strength). The time $t_r$ increases with increasing thickness of the ECM layer, but does not change with ΔT.

Figure 3:
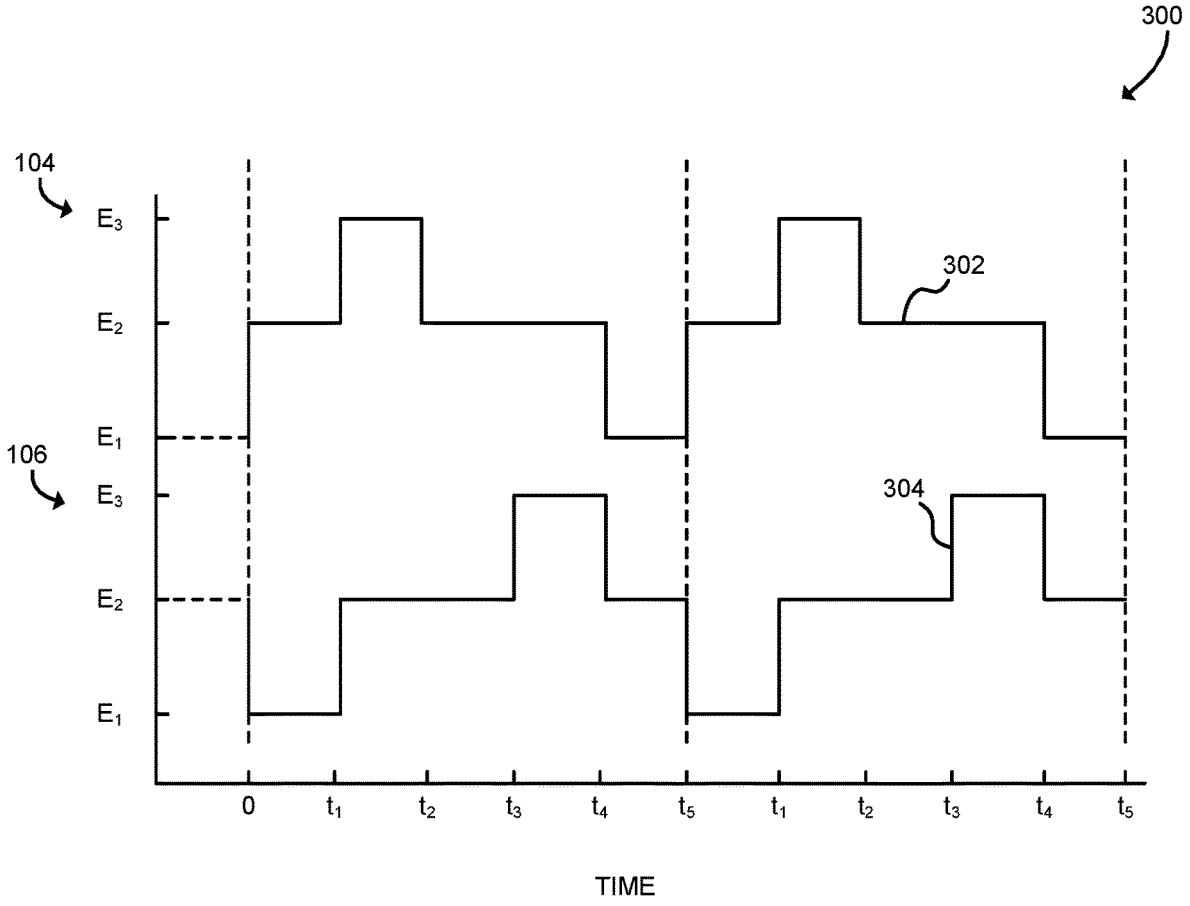
FIG. 3 is a chart illustrating another embodiment of coordinated electric fields that may be used with the electrocaloric heat pump device of FIG. 1.

Referring now to FIG. 3, diagram 300 illustrates another potential embodiment of time-dependent electric fields that may be applied to the heat pump 100. Curve 302 illustrates electric field applied to the ECM layer 104, and curve 304 illustrates electric field applied to the ECM layer 106. As shown, at time zero, electric field strength in the ECM layer 104 is increased from $E_1$ to $E_2$. This change is applied adiabatically, which causes the temperature of the ECM layer 104 to increase, and causes temperature of the ECM layer 106 to decrease. The components of the heat pump 100 e.g., the heat sink 102, the ECM layers 104, 106, and the heat source 108) are allowed to reach the equilibrium temperature T (or within some tolerance of the equilibrium temperature T) through thermal conduction. Accordingly, the ECM layer 104 releases heat in an amount Q, and the ECM layer 106 absorbs heat in the amount Q. Assuming initial temperatures of the layers 104, 106 are the same and that all materials have the same thermal properties, this results in an amount of heat up to Q/2 flowing from the ECM layer 104 to the heat sink 102 and the amount of heat up to Q/2 flowing from the heat source 108 to the ECM layer 106.

As a next step, at time $t_1$, electric field strength is increased in both ECM layers 104, 106 (i.e., from $E_2$ to $E_3$ in the layer 104 and from $E_1$ to $E_2$ in the layer 106). This causes both ECM layers 104, 106 to release heat, resulting in no heat flow between the layers 104, 106. This causes heat in the amount Q to flow from the layer 104 to the heat sink 102 and heat in the amount Q to flow from the layer 106 to the heat source 108.

As a next step, at time $t_2$, electric field strength in the ECM layer 104 is decreased from $E_3$ to $E_2$ and electric field strength in the ECM layer 106 is maintained at $E_2$. This causes the layer 104 to absorb heat in the amount Q. Heat flows from the heat sink 102 into the ECM layer 104 in the amount Q/2 and heat flows from the heat source 108 to the ECM layer 106 in the amount Q/2.

As a next step, at time $t_3$, electric field strength in the ECM layer 104 is maintained at $E_2$ and electric field strength in the ECM layer 106 is increased from $E_2$ to $E_3$. This causes the layer 106 to release heat in the amount Q. Heat flows from the layer 106 to the heat source 108 in the amount Q/2 and heat flows from the layer 104 to the heat sink in the amount Q/2.

As a last step in the cycle, at time $t_4$, electric field strength is decreased in both ECM layers 104, 106 (i.e., from $E_2$ to $E_1$ in the layer 104 and from $E_3$ to $E_2$ in the layer 106). This causes both ECM layers 104, 106 to absorb heat, resulting in no heat flow between the layers 104, 106. The causes heat in the amount Q to flow from the heat sink 102 to the layer 104, and causes heat in the amount Q to flow from the heat source 108 to the layer 106. Thus, heat flows resulting from electric field changes at $t_1$ through $t_4$ cancel each other out. Accordingly, after reaching the equilibrium temperature immediately before time $t_5$, the total net heat flow is an amount up to Q/2 from the heat source 108 to the heat sink 102. Additionally, immediately before $t_5$, the electric field strength in the ECM layers 104, 106 are returned to their initial conditions from immediately prior to time zero. As shown, the time-dependent electric fields applied to the ECM layers 104, 106 maybe repeated in multiple cycles, with each cycle moving up to Q/2 thermal energy from the heat source 108 to the heat sink 102.

Figure 4:
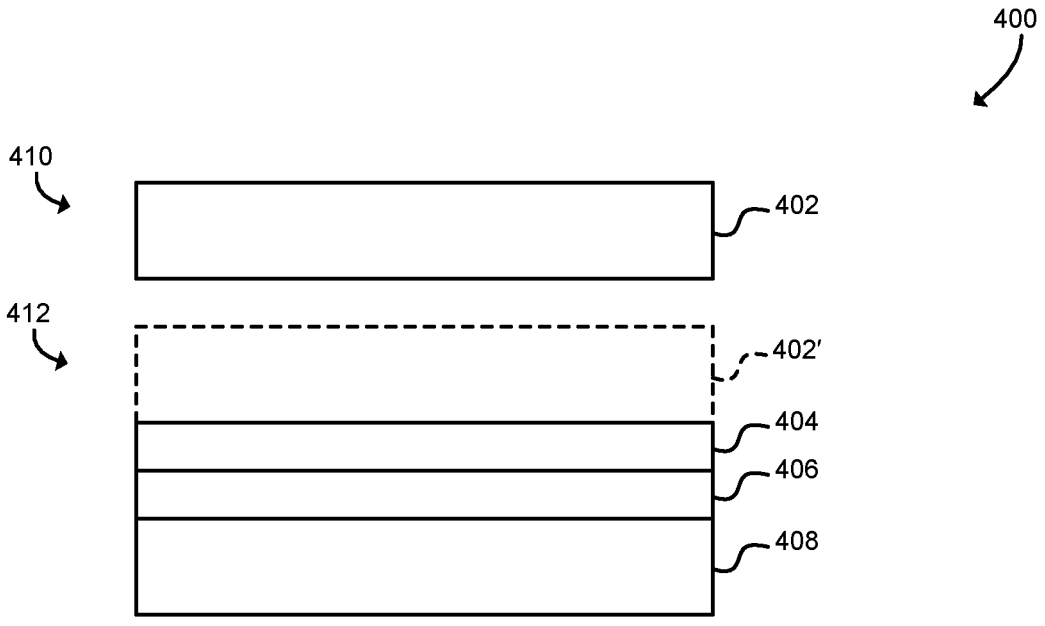
FIG. 4 is a schematic diagram of at least one other embodiment of a multi-layer electrocaloric heat pump device.

Referring now to FIG. 4, another embodiment of an illustrative electrocaloric heat pump device 400 includes a heat sink 402, electrocaloric material (ECM) layers 404, 406, and a heat source 408. Each of those components are similar to the corresponding components shown in FIG. 1, and thus the description of each is not repeated herein so as not to obscure the disclosure. Similar to the heat pump 100 shown in FIG. 1, the ECM layers 404, 406 are bonded or otherwise permanently attached to each other, and the bottom ECM layer 406 is bonded or otherwise permanently attached to the heat source 408. However, in contrast to the heat pump 100 of FIG. 1, the heat sink 402 is not permanently attached to the top ECM layer 404. Rather, the heat sink 402 may be removably attached to the ECM layer 404. As shown, the heat sink 402 may be moved from a position 410 in which the heat sink 402 is spaced apart from the ECM layer 404 to a position 412 in which the heat sink 402 is in contact with the ECM layer 404, which is illustrated in FIG. 4 in phantom as the heat sink 402'. Thus, although the heat sink 402 may be a moving part, in some embodiments the ECM layers 404, 406 as well as any supporting wiring and other control electronics may not be moving parts. Thus, the heat pump 400 disclosed herein may also have improved reliability and/or reduced costs as compared to existing ECM cooling systems that rely on moving ECM components and/or other moving components. Additionally, cooling power achieved by the heat pump 400 is insensitive to materials used as the heat sink 402 and the heat source 408. For example, changing heat source/heat sink material from a good thermal conductor (e.g., metals) to a poor thermal conductor (e.g., ceramics/polymers), the cooling power of conventional ECE-based systems may change over 100 times, whereas cooling power of the heat pump 400 may change less than two times.

Figure 5:
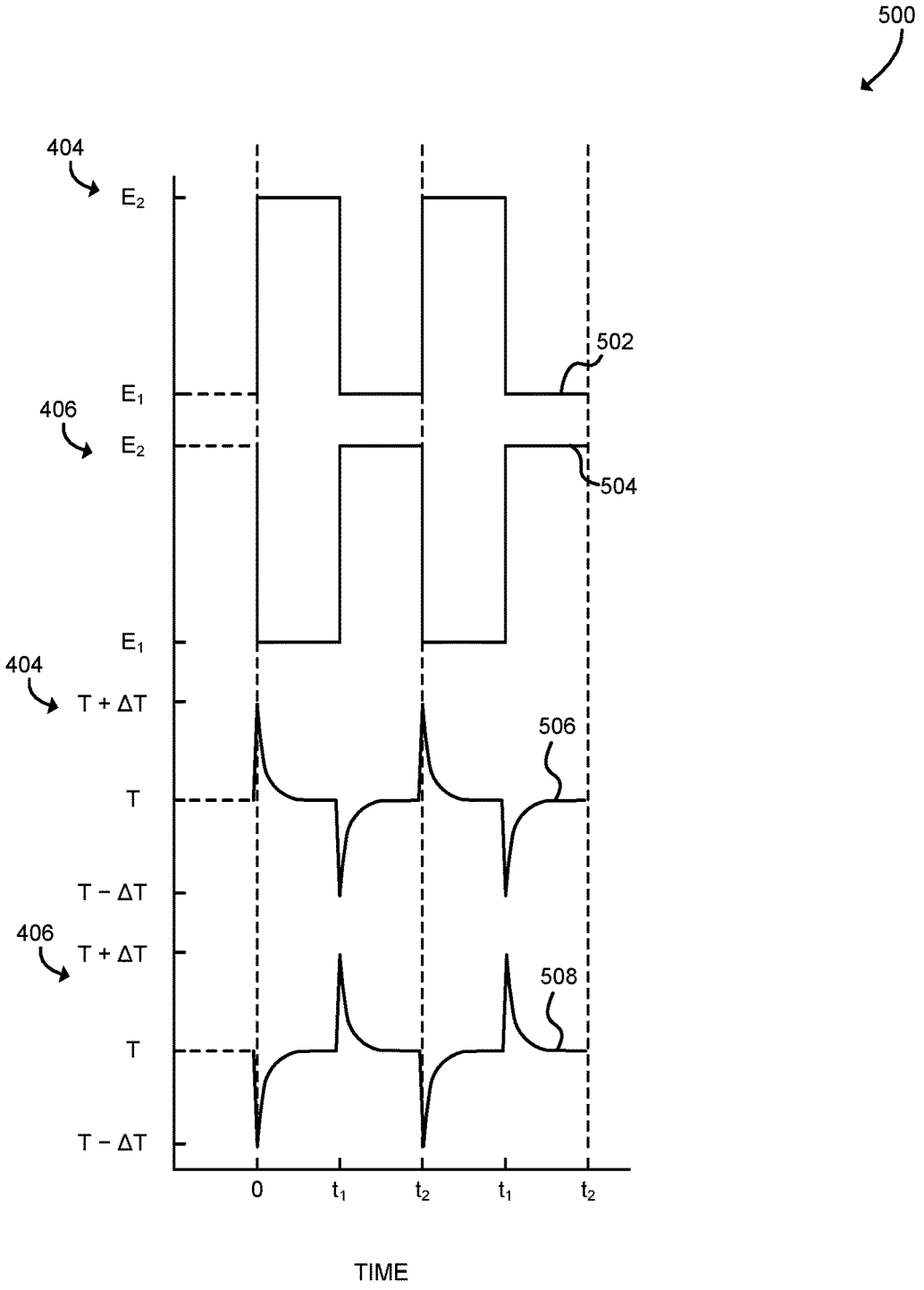
FIG. 5 is a chart illustrating at least one embodiment of coordinated electric fields and associated temperatures that may be used with the electrocaloric heat pump device of FIG. 4.

Referring now to FIG. 5, diagram 500 illustrates one potential embodiment of time-dependent electric fields that may be applied to the heat pump 400. Curve 502 illustrates electric field applied to the ECM layer 404, and curve 504 illustrates electric field applied to the ECM layer 406. Curve 506 illustrates temperature at the center of the ECM layer 404, and curve 508 illustrates temperature at the center of the ECM layer 406. At time zero, the heat sink 402 is in position 412, in which the heat sink 402 is in contact with the ECM layer 404. Illustratively, at time zero, all components of the heat pump 400 (e.g., the heat sink 402, the ECM layers 404, 406, and the heat source 408) are at an equilibrium temperature T. As shown, at time zero, electric field strength in the ECM layer 404 is increased from $E_1$ to $E_2$. This change is applied adiabatically, which causes the temperature of the ECM layer 404 to increase by ΔT. Similarly, at time zero, electric field strength in the ECM layer 406 is decreased from $E_2$ to $E_1$, causing temperature of the ECM layer 406 to decrease by ΔT. The components of the heat pump 400 e.g., the heat sink 402, the ECM layers 404, 406, and the heat source 408) are allowed to reach the equilibrium temperature T (or within some tolerance of the equilibrium temperature T) through thermal conduction. Accordingly, the ECM layer 404 releases heat in an amount Q, and the ECM layer 406 absorbs heat in the amount Q. Assuming initial temperatures of the layers 404, 406 are the same and that all materials have the same thermal properties, this results in an amount of heat up to Q/2 flowing from the ECM layer 404 to the heat sink 402 and the amount of heat up to Q/2 flowing from the heat source 408 to the ECM layer 406.

At time $t_1$, the heat sink 402 is moved to the position 410 and is thus no longer in contact with the top ECM layer 404. This means that the heat sink 402 is effectively replaced by air, which eliminates or greatly reduces thermal transfer between the heat sink 402 and the top layer 404. Also at time $t_1$ or otherwise once the heat sink 402 is removed from the top layer 404, the electric field strength in the ECM layer 404 is decreased from $E_2$ to $E_1$, and the electric field strength in the ECM layer 406 is increased from $E_1$ to $E_2$. This causes temperature of the ECM layer 404 to decrease by ΔT, and causes temperature of the ECM layer 406 to increase by ΔT. Accordingly, the ECM layer 404 absorbs heat in the amount Q and the ECM layer 406 releases heat in the amount Q, which results in no net heat flow between the heat source 408 and the ECM layer 406. Accordingly, after reaching the equilibrium temperature immediately before time $t_2$, the total net heat flow is an amount up to Q/2 from the heat source 408 to the heat sink 402. Additionally, immediately before $t_2$, the electric field strengths in the ECM layers 404, 406 are returned to their initial conditions from immediately prior to time zero. As shown, the time-dependent electric fields applied to the ECM layers 404, 406 (as well as attaching and removing the heat sink 402) maybe repeated in multiple cycles, with each cycle moving up to Q/2 thermal energy from the heat source 408 to the heat sink 402.

Figure 6:
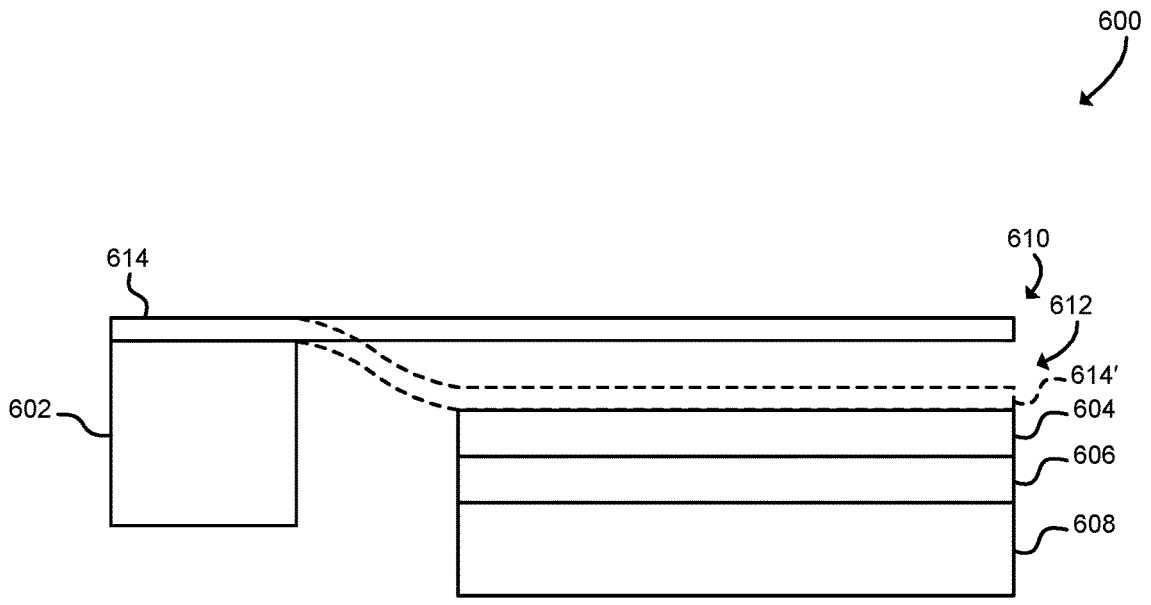
FIG. 6 is a schematic diagram of at least one additional other embodiment of a multi-layer electrocaloric heat pump device including a conductive cantilever.

Referring now to FIG. 6, another embodiment of an illustrative electrocaloric heat pump device 600 includes a heat sink 602, electrocaloric material (ECM) layers 604, 606, and a heat source 608. Each of those components are similar to the corresponding components shown in FIGS. 1 and 4, and thus the description of each is not repeated herein so as not to obscure the disclosure. Similar to the heat pumps 100, 400 the ECM layers 604, 606 are bonded or otherwise permanently attached to each other, and the bottom ECM layer 606 is bonded or otherwise permanently attached to the heat source 608. Similar to the heat pump 400 shown in FIG. 4, the heat sink 602 may be removably attached to the ECM layer 604. As shown, the heat sink 602 is coupled to a cantilever 614. The cantilever 614 is formed from or otherwise includes a thermally conductive material such as a metallic material. The cantilever 614 may be moved from a position 610 in which the cantilever 614 is spaced apart from the ECM layer 604 to a position 612 in which the cantilever 614 is in contact with the ECM layer 404, which is illustrated in FIG. 6 in phantom as the cantilever 614'. When in the cantilever 614' is in the position 612, the heat sink 602 is thermally coupled to the ECM layer 604 and thus heat may flow between the ECM layer 604 and the heat sink 602. The cantilever 614 may be moved between the positions 610, 612 using one or more piezoelectric actuators, electromagnetic actuators, or other mechanical actuators. In some embodiments, the cantilever 614 may be formed from a piezoelectric beam and may include a thermally conductive trace, coating, or other thermal conductor. Time-dependent electric fields may be applied to the ECM layers 604, 606 as illustrated in FIG. 5, causing heat to be transferred from the heat source 608 to the heat sink 602.

Figure 7:
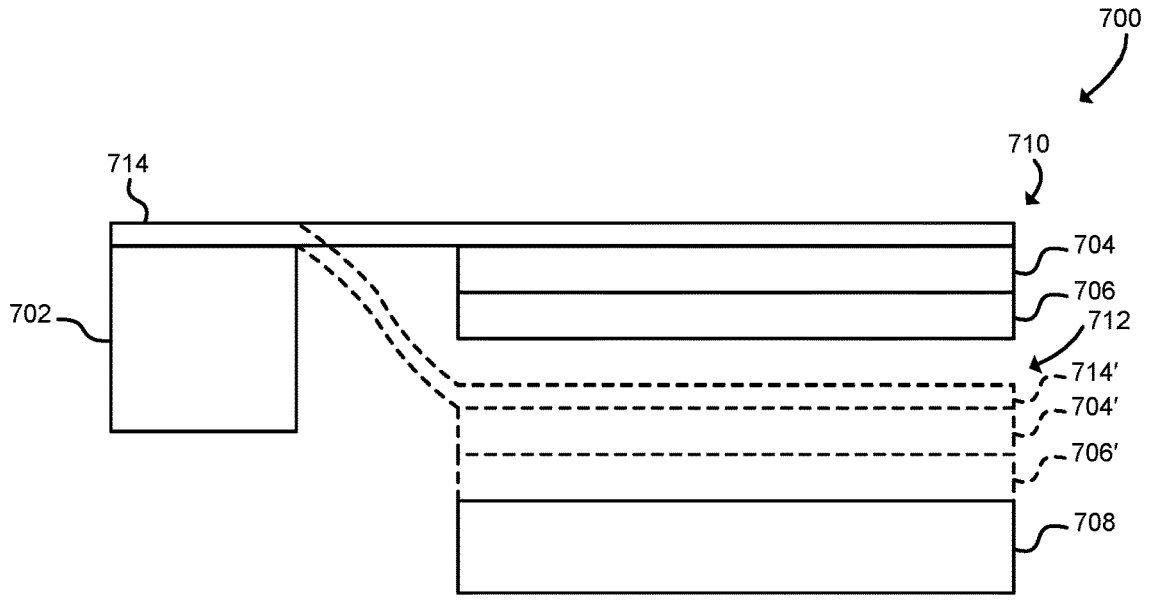
FIG. 7 is a schematic diagram of yet another at least one embodiment of a multi-layer electrocaloric heat pump device including a conductive cantilever.

Referring now to FIG. 7, another embodiment of an illustrative electrocaloric heat pump device 700 includes a heat sink 702, electrocaloric material (ECM) layers 704, 706, and a heat source 708. Each of those components are similar to the corresponding components shown in FIGS. 1, 4, and 6, and thus the description of each is not repeated herein so as not to obscure the disclosure. Similar to the heat pump 600 shown in FIG. 6, the heat pump 700 includes a cantilever 714 coupled to the heat sink 702. The cantilever 714 is formed from or otherwise includes a thermally conductive material such as a metallic material. The ECM layers 704, 706 are bonded or otherwise permanently attached to each other, and the top ECM layer 704 is bonded or otherwise permanently attached to the cantilever 714. However, the bottom ECM layer 706 is not permanently attached to the heat source 708. Rather, the ECM layer 706 may be removably attached to the heat source 708. As shown, the cantilever 714 may be moved from a position 710 in which the ECM layer 706 is spaced apart from the heat source 708 to a position 712 in which the ECM layer 706 is in contact with the heat source 708, which is illustrated in FIG. 7 in phantom as the cantilever 714' and the ECM layers 704', 706'. When in the cantilever 714' is in the position 712, the heat source 708 is thermally coupled to the ECM layer 706 and thus heat may flow between the heat source 708 and the ECM layer 706. As discussed above, the cantilever 714 may be moved between the positions 710, 712 using one or more piezoelectric actuators, electromagnetic actuators, or other mechanical actuators. In some embodiments, the cantilever 714 may be formed from a piezoelectric beam and may include a thermally conductive trace, coating, or other thermal conductor. Time-dependent electric fields may be applied to the ECM layers 704, 706 as illustrated in FIG. 5, causing heat to be transferred from the heat source 708 to the heat sink 702.

Figure 8:
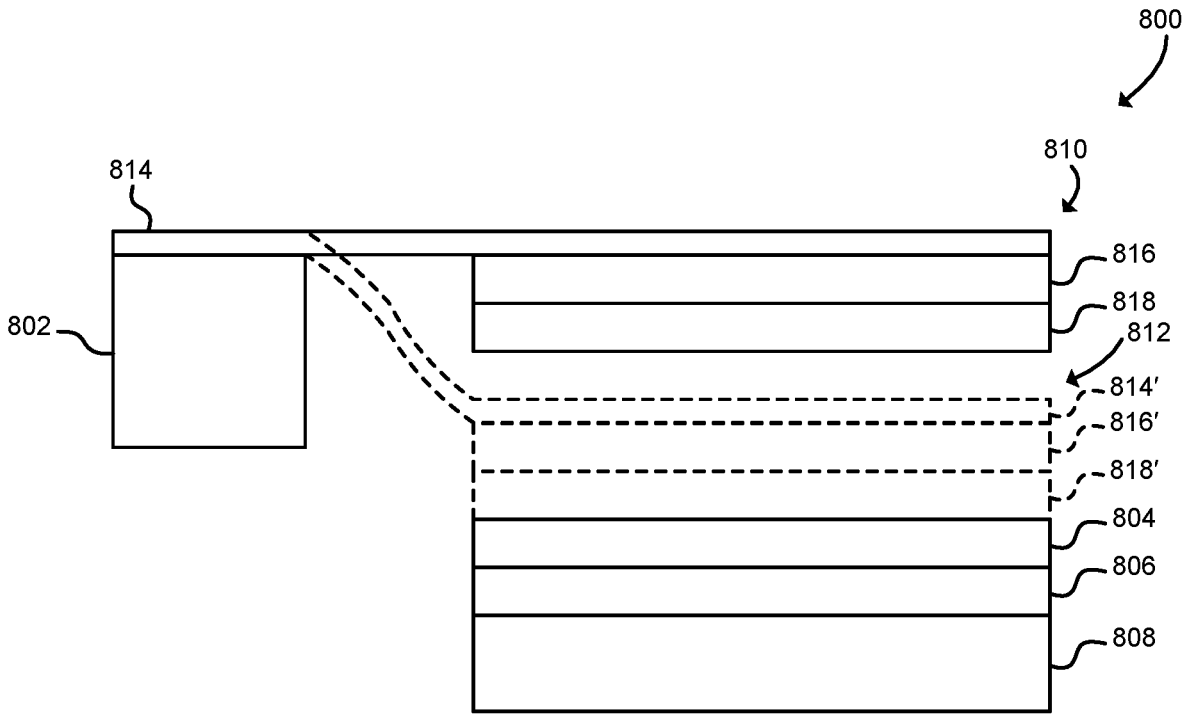
FIG. 8 is a schematic diagram of still yet another at least one embodiment of a multi-layer electrocaloric heat pump device including a conductive cantilever.

Referring now to FIG. 8, another embodiment of an illustrative electrocaloric heat pump device 800 includes a heat sink 802, electrocaloric material (ECM) layers 804, 806, and a heat source 808. Each of those components are similar to the corresponding components shown in FIGS. 1, 4, 6, and 7, and thus the description of each is not repeated herein so as not to obscure the disclosure. As shown, the ECM layers 804, 806 are bonded or otherwise permanently attached to each other, and the bottom ECM layer 806 is bonded or otherwise permanently attached to the heat source 808. Similar to the heat pumps 600, 700 the heat pump 800 includes a cantilever 814 coupled to the heat sink 802. The cantilever 814 is formed from or otherwise includes a thermally conductive material such as a metallic material. The heat pump 800 also includes additional ECM layers 816, 818. The ECM layers 816, 818 are bonded or otherwise permanently attached to each other, and the top ECM layer 816 is bonded or otherwise permanently attached to the cantilever 814. As shown, the cantilever 814 may be moved from a position 810 in which the ECM layer 818 is spaced apart from the ECM layer 804 to a position 812 in which the ECM layer 818 is in contact with the ECM layer 804, which is illustrated in FIG. 8 in phantom as the cantilever 814' and the ECM layers 816', 818'. When in the cantilever 814' is in the position 812, the ECM layers 818', 804 are thermally coupled together and thus heat may flow between the heat source 808 and the heat sink 802. As discussed above, the cantilever 814 may be moved between the positions 810, 812 using one or more piezoelectric actuators, electromagnetic actuators, or other mechanical actuators. In some embodiments, the cantilever 814 may be formed from a piezoelectric beam and may include a thermally conductive trace, coating, or other thermal conductor. Time-dependent electric fields may be applied to the ECM layers 804, 806, 816, 818 as illustrated in FIG. 5, causing heat to be transferred from the heat source 808 to the heat sink 802. In particular, electric fields similar to the curve 502 shown in FIG. 5 may be applied to the ECM layers 804, 816, and electric fields similar to the curve 504 shown in FIG. 5 may be applied to the ECM layers 806, 818.

While certain illustrative embodiments have been described in detail in the figures and the foregoing description, such an illustration and description is to be considered as exemplary and not restrictive in character, it being understood that only illustrative embodiments have been shown and described and that all changes and modifications that come within the spirit of the disclosure are desired to be protected. There are a plurality of advantages of the present disclosure arising from the various features of the apparatus, systems, and methods described herein. It will be noted that alternative embodiments of the apparatus, systems, and methods of the present disclosure may not include all of the features described yet still benefit from at least some of the advantages of such features. Those of ordinary skill in the art may readily devise their own implementations of the apparatus, systems, and methods that incorporate one or more of the features of the present disclosure.

The invention claimed is:

1. A cooling system comprising:

a heat source;

a plurality of electrocaloric material layers coupled to the heat source, wherein an electric field applied to each electrocaloric material layer is independently controllable; and a heat sink coupled to the plurality of electrocaloric material layers;

wherein the electric field applied to each electrocaloric material layer is operated to: (i) move a first amount of heat energy from the heat source to the heat sink during a first interval and (ii) restore an initial condition of the plurality of electrocaloric material layers during a second interval after the first interval.

2. The cooling system of claim 1, wherein the plurality of electrocaloric material layers are separated by layers of electrically conductive materials.

3. The cooling system of claim 1, wherein the plurality of electrocaloric material layers are separated by layers of electrically insulative materials.

4. The cooling system of claim 1, wherein the plurality of electrocaloric material layers comprises lead magnesium niobate (PMN) or barium titanate (BT) and the heat sink comprises copper, silver, or aluminum.

5. The cooling system of claim 1, wherein the heat source comprises a silicon die.

6. The cooling system of claim 1, further comprising a controller coupled to the plurality of electrocaloric material layers and configured to independently control the electric field applied to each electrocaloric material layer.

7. The cooling system of claim 1, wherein the plurality of electrocaloric material layers comprises a first layer and a second layer, wherein the first layer is bonded to the heat sink and the second layer, and wherein the second layer is bonded to the first layer and the heat source.

8. The cooling system of claim 7, wherein:

during the first interval, (i) a first electric field applied to the first layer is increased from a first field strength to a second field strength thereby causing a temperature of the first layer to increase from an equilibrium temperature by a predetermined temperature delta and (ii) a second electric field applied to the second layer is decreased from the second field strength to the first field strength thereby causing a temperature of the second layer to decrease from the equilibrium temperature by the predetermined temperature delta;

during a first subinterval of the second interval, (i) the first electric field is decreased from the second field strength to the first field strength thereby causing the temperature of the first layer to decrease from the equilibrium temperature by the predetermined temperature delta and (ii) the second electric field is maintained; and during a second subinterval of the second interval, (i) the first electric field is maintained and (ii) the second electric field is increased from the first field strength to the second field strength thereby causing the temperature of the second layer to increase from the equilibrium temperature by the predetermined temperature delta.

9. The cooling system of claim 8, wherein:

during a third subinterval of the second interval prior to the first subinterval, the first electric field is increased and the second electric field is increased; and during a fourth subinterval of the second interval after the second subinterval, the first electric field is decreased and the second electric field is decreased.

10. The cooling system of claim 8, wherein the first interval lasts a predetermined time until the first amount of heat energy is transferred to the heat sink, and wherein each of the first subinterval and the second subinterval lasts until the heat sink, the plurality of electrocaloric material layers, and the heat source reach the equilibrium temperature.

11. The cooling system of claim 10, wherein the first interval lasts until a temperature maximum reaches an interface between the first layer and the heat sink.

12. The cooling system of claim 1, wherein a net heat transfer during the second interval between the heat source and the heat sink is zero.

13. The cooling system of claim 1, wherein the initial condition comprises a respective initial electric field strength for each layer of the plurality of electrocaloric material layers, and wherein the initial condition comprises an equilibrium temperature for the plurality of electrocaloric material layers.

14. The cooling system of claim 1, wherein the plurality of electrocaloric material layers comprises a first layer bonded to a second layer, wherein the first layer is detachably coupled to a first component of the heat sink and the heat source, and wherein the second layer is bonded to a second component of the heat sink and the heat source other than the first component.

15. The cooling system of claim 14, during the first interval, (i) the first component of the heat sink and the heat source is attached to the first layer, (ii) a first electric field applied to the first layer is increased from a first field strength to a second field strength thereby causing a temperature of the first layer to increase from an equilibrium temperature by a predetermined temperature delta, and (iii) a second electric field applied to the second layer is decreased from the second field strength to the first field strength thereby causing a temperature of the second layer to decrease from the equilibrium temperature by the predetermined temperature delta; and during the second interval, (i) the first component of the heat sink and the heat source is detached from the first layer, (ii) the first electric field is decreased from the second field strength to the first field strength thereby causing the temperature of the first layer to decrease from the equilibrium temperature by the predetermined temperature delta and (ii) the second electric field is increased from the first field strength to the second field strength thereby causing a temperature of the second layer to increase from the equilibrium temperature by the predetermined temperature delta.

16. The cooling system of claim 14, wherein the first interval lasts a predetermined time until the first amount of heat energy is transferred to the heat sink, and wherein the second interval lasts until the plurality of electrocaloric material layers and the heat source reach the equilibrium temperature.

17. The cooling system of claim 14, wherein the first interval lasts until a temperature maximum reaches an interface between the first layer and the heat sink.

18. The cooling system of claim 14, further comprising an electrically conductive cantilever coupled to the heat sink, wherein the cantilever is moveable between a first position in which the cantilever contacts the first layer and a second position in which the cantilever is spaced apart from the first layer.

19. The cooling system of claim 14, further comprising an electrically conductive cantilever coupled to the heat sink, wherein the cantilever is bonded to the second layer, and wherein the cantilever is moveable between a first position in which the first layer contacts the heat source and a second position in which the first layer is spaced apart from the heat source.

20. The cooling system of claim 14, further comprising an electrically conductive cantilever coupled to the heat sink;

wherein the plurality of electrocaloric material layers further comprise a third layer bonded to the cantilever and a fourth layer bonded to the third layer;

wherein the cantilever is moveable between a first position in which the fourth layer contacts the first layer and a second position in which the fourth layer is spaced apart from the first layer.

* * * * *